United States Patent [19]

Kinoshita

[11] Patent Number: 4,860,604

[45] Date of Patent: Aug. 29, 1989

[54] STARTER

[75] Inventor: Takashi Kinoshita, Hyogo, Japan

[73] Assignee: Mitsubishi Denki Kabushiki Kaisha, Tokyo, Japan

[21] Appl. No.: 166,038

[22] Filed: Mar. 9, 1988

[30] Foreign Application Priority Data

Mar. 10, 1987 [JP] Japan ..... 62-55929

[51] Int. Cl.[4] ..... F02N 15/06

[52] U.S. Cl. ..... 74/7 E; 74/7 A; 74/7 C; 74/801

[58] Field of Search ..... 74/7 A, 7 C, 7 E, 7 R, 74/801

[56] References Cited

U.S. PATENT DOCUMENTS

| | | | |
|---|---|---|---|
| 4,304,140 | 12/1981 | Ebihara | 74/7 A |
| 4,412,457 | 11/1983 | Colvin et al. | 74/7 E |
| 4,464,576 | 8/1984 | Williams | 74/7 C |
| 4,507,978 | 4/1985 | Tanaka et al. | 74/7 E |
| 4,510,406 | 4/1985 | Morishita | 74/7 E |
| 4,573,364 | 3/1986 | Givan | 74/7 E |
| 4,587,861 | 5/1986 | Morishita | 74/7 E |
| 4,671,125 | 6/1987 | Yabunaka | 74/7 E |

FOREIGN PATENT DOCUMENTS

| | | | |
|---|---|---|---|
| 60-175763 | 9/1985 | Japan . | |
| 159368 | 6/1957 | Sweden | 74/7 E |
| 631580 | 11/1949 | United Kingdom | 74/7 A |

*Primary Examiner*—Allan D. Herrmann

*Attorney, Agent, or Firm*—Wolf, Greenfield & Sacks

[57] ABSTRACT

A starter having an epicyclic reduction gear which may be used to start an engine of a vehicle is disclosed. The center bracket and the bearing fitted thereto which have heretofore been employed are eliminated, and instead the armature rotary shaft of a motor is extended forwardly so that a primary output shaft which is integral with a carrier of the epicyclic reduction gear is supported by the extended shaft portion, and the primary output shaft and an outer race of an overrunning clutch are spline-engaged with each other. Thus, it is possible to reduce the overall length of the starter by a large margin as compared with the prior art. Since it becomes unnecessary to employ the driving shaft and other elements which have heretofore been needed, the number of required parts is reduced and it becomes easy to center the carrier of the epicyclic reduction gear and the overrunning clutch. Accordingly, it is possible to improve the reliability of the starter.

12 Claims, 2 Drawing Sheets

STARTER

BACKGROUND OF THE INVENTION

1. Field of the Invention

The present invention relates to a starter and, more particularly, to a starter which is equipped with an epicyclic reduction gear and which is used to start an engine of a vehicle.

2. Description of the Prior Art

A conventional starter used to start an engine of a vehicle has heretofore been arranged as shown in FIG. 2.

The conventional starter 1 shown in FIG. 2 has a d.c. motor 2 for generating the rotational force that is used to start an engine. An epicyclic reduction gear 3 is disposed adjacent to the forward end (that is, the right-hand end as viewed in FIG. 2) of the latter. The epicyclic reduction gear 3 comprises a sun gear 3*a* which is in fitting engagement with straight splines 2*b* formed in the outer peripheral surface of the end portion of an armature rotary shaft 2*a* of the motor 2, an internal gear 3*b* disposed around the sun gear 3*a*, and planet gears 3*c* which are meshed with both the sun gear 3*a* and the internal gear 3*b* to revolve about the sun gear 3*a* while rotating around their own axes. The planet gears 3*a* are supported on a carrier 3*e* through respective pins 3*d*.

At the forward end of the d.c. motor 2, a driving shaft 4 which is a member separate from the armature rotary shaft 2*a* is disposed on the same axis as the central axis of the shaft 2*a*. A boss-shaped tubular portion of the carrier 3*e* that constitutes the epicyclic reduction gear 3 is firmly fitted on the rear end of the driving shaft 4 by means of spline engagement. The internal gear 3*b* that also constitutes the epicyclic reduction gear 3 is formed integral with a center bracket 5. The boss-shaped tubular portion of the carrier 3*b* is rotatably supported through a bearing 6 which is fitted to the center bracket 5.

An overrunning clutch 7 is axially slidably supported on the driving shaft 4 at a position which is adjacent to the forward end of the center bracket 5. More specifically, the overrunning clutch 7 consists of a clutch outer member 7*a* and a clutch inner member 7*c*. The clutch outer member 7*a* is meshed with a helical spline 4*a* formed in the driving shaft 4 so that the rotation of the driving shaft 4 is transmitted to the clutch inner member 7*c* through rollers 7*b*. The clutch inner member 7*c* has a tubular output shaft portion 7*d* which is formed integral therewith and which is fitted and supported on the driving shaft 4 through a bearing 8. The outer periphery of the output shaft portion 7*d* is supported by a bearing 10 which is firmly fitted to a front bracket 9 defining a machine frame of the starter 1. A pinion 11 which is engageable with a ring gear (not shown) of the engine is secured to the distal end of the output shaft portion 7*d*.

It should be noted that the reference numeral 12 in FIG. 2 denotes an electromagnetic switch which is arranged to shift the overrunning clutch 7 at the same time as the power supply of the d.c. motor 2 is turned on. One end of a shift lever 13 is engaged with a plunger rod of the switch 12, while the other end of the shift lever 13 is engaged with a circumferential groove which is formed in the outer peripheral surface of the clutch outer member 7*a* of the overrunning clutch 7.

As described above, in the conventional starter, the armature rotary shaft 2*a* of the d.c. motor 2 is separated from the driving shaft 4, and one end of the driving shaft 4, together with the boss-shaped tubular portion of the carrier 3*e*, is supported through the bearing 6 which is fitted to the center bracket 5 formed integral with the internal gear 3*b* of the epicyclic reduction gear 3. Hence, the prior art suffers from the problem that the overall length of the starter is disadvantageously long.

SUMMARY OF THE INVENTION

In view of the above-described circumstances, it is a primary object of the present invention to provide a starter which has a reduced overall length and hence a reduced overall size.

To this end, the present invention provides a starter comprising: a motor for generating rotational force used to start an engine; an epicyclic reduction gear having an internal gear integrally formed on the inner peripheral surface of an end portion of a casing of the motor to reduce the speed of rotation of the motor, planet gears meshed with the internal gear, and a carrier for supporting the orbital motion of the planet gears; a tubular primary output shaft formed integral with the carrier and fitted on an extended shaft portion of an armature rotary shaft of the motor through a bearing; an overrunning clutch having an outer race which is axially slidably supported on said extended shaft portion and which is in spline engagement with the primary output shaft; a tubular secondary output shaft formed integral with an inner race of the overrunning clutch and rotatably as well as axially slidably supported on said extended shaft portion through a bearing; shift means for applying axial force to cause the overrunning clutch to slide; a bearing device secured to a machine frame to support the secondary output shaft rotatably; and a pinion disposed at the distal end of the secondary output shaft.

By virtue of the above-described arrangement, at the same time as the power supply of the motor is turned on, the overrunning clutch is caused to move axially on the armature rotary shaft by the action of the shift means, and the pinion provided on the end portion of the secondary output shaft which is integral with the inner race is meshed with the ring gear of the engine. The rotation of the motor is transmitted from the armature rotary shaft to the carrier through the planet gears to rotate the outer race which is in spline engagement with the tubular primary output shaft formed integral with the carrier. The rotation of the outer race is transmitted to the inner race, and the pinion is thereby rotated to start the engine. It should be noted that the reverse transmission of rotational force to the armature rotary shaft after the starting of the engine is cut off by the overrunning clutch.

BRIEF DESCRIPTION OF THE DRAWINGS

The above and other objects, features and advantages of the present invention will become more apparent from the following description of the preferred embodiment thereof taken in conjunction with the accompanying drawings in which.

DESCRIPTION OF THE PREFERRED EMBODIMENT

The starter according to the present invention will be described hereinunder in more detail by way of one preferred embodiment and with reference to FIG. 1.

Figure 1:
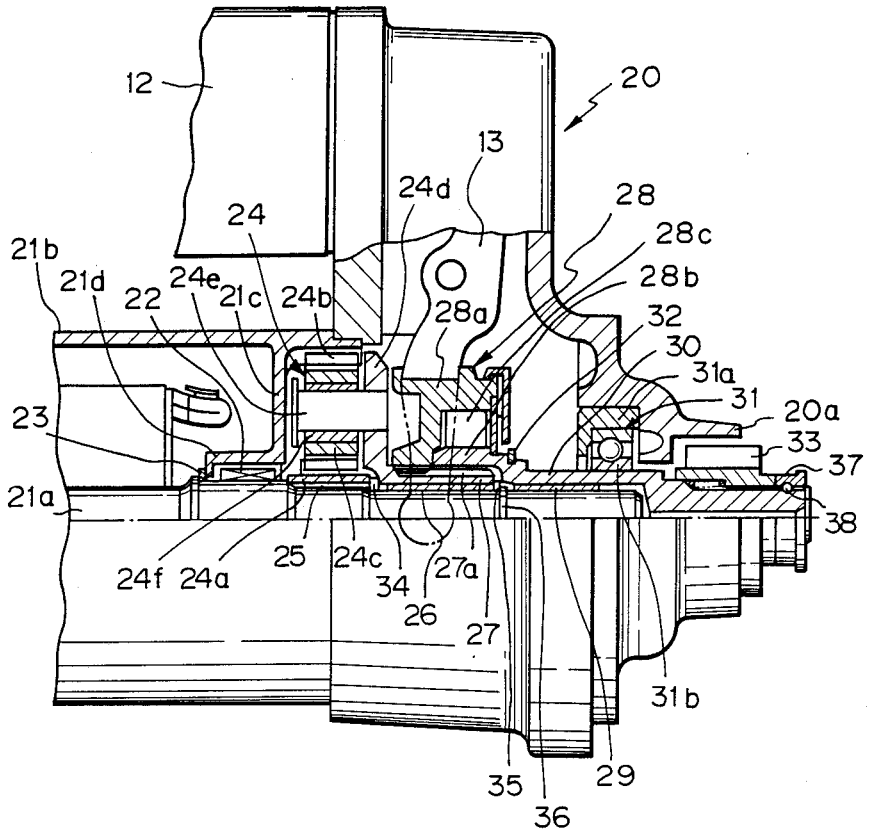
FIG. 1 is a fragmentary sectional view of one embodiment of the starter according to the present invention.
Figure 2:
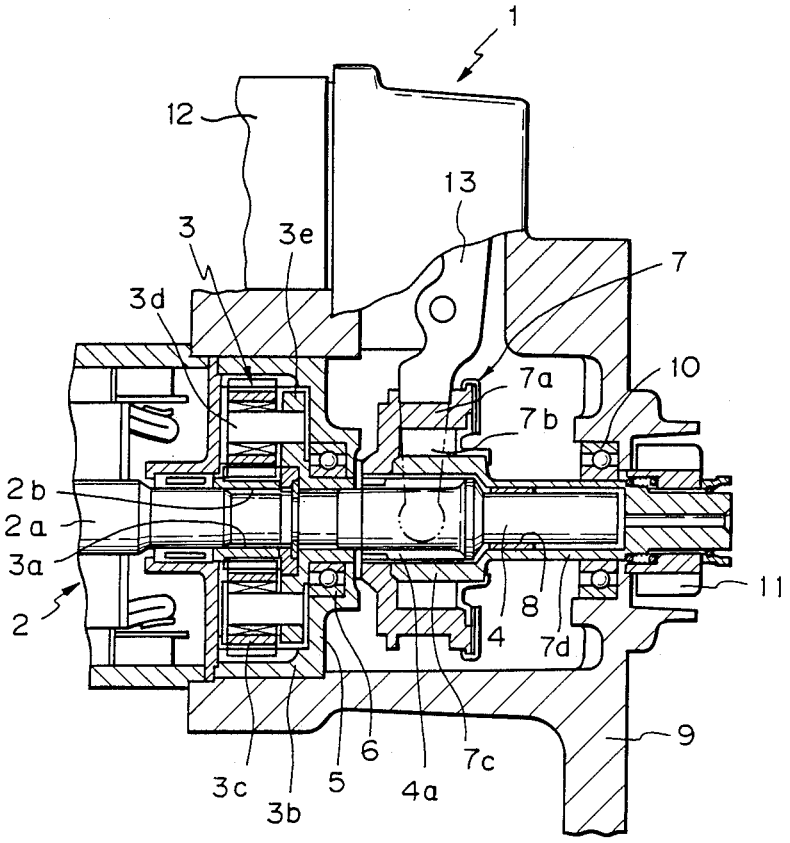
Fig. 2 PRIOR ART
FIG. 2 is a fragmentary sectional view of a conventional starter.

FIG. 1 shows a starter 20 arranged in accordance with one embodiment of the present invention. The starter 20 includes a d.c. motor 21, and the armature rotary shaft 21*a* of the motor 21 has an extended shaft portion which projects forwardly (rightwardly as viewed in FIG. 1) from an end wall 21*c* of a casing 21*b*. The inner end portion of the end wall 21*c* of the casing 21*b* is bent rearwardly (leftwardly as viewed in FIG. 1) to define a bearing retainer portion 21*d*. The armature rotary shaft 21*a* is rotatably supported through a bearing 22 which is provided on the retainer portion 21*d*. A stopper plate 23 is secured to the peripheral surface of the armature rotary shaft 21*a* at a position which is in the vicinity of the bearing retainer portion 21*d* and at the inner side of the casing 21*b*, the plate 23 coming into contact with the end face of the retainer portion 21*d* to thereby prevent the forward movement of the armature rotary shaft 21*a*.

At the forward end of the d.c. motor 21, an epicyclic reduction gear 24 is disposed in close proximity with the end wall 21*c*. The epicyclic reduction train 24 comprises a sun gear 24*a* which is in fitting engagement with straight splines 25 which are formed in the extended shaft portion of the armature rotary shaft 21*a*, an internal gear 24*b* disposed around the sun gear 24*a*, the internal gear 24*b* being formed on the axially extending peripheral wall of the casing 21*b* of the d.c. motor 21 and generating teeth on the inner peripheral surface of the extended peripheral wall, and a plurality of planet gears 24*c* which are meshed with both the sun gear 24*a* and the internal gear 24*b* so as to revolve about the sun gear 24*a* while rotating around their own axes. Each planet gear 24*c* is rotatably supported through a bearing 24*f* on a pin 24*e* which is rigidly secured to a disk-shaped carrier 24*d*. The carrier 24*d* has a tubular portion 27 which is fitted on the extended shaft portion of the armature rotary shaft 21*a* of the d.c. motor 21 through a bearing 26, the tubular portion 27 and the carrier 24*d* being formed integral with each other in this embodiment. The tubular portion 27 will be hereinafter referred to as the "primary output shaft".

An overrunning clutch 28 is disposed on the primary output shaft 27 at a position which is adjacent to the carrier 24*d*. The clutch 28 consists of an outer race 28*a* and an inner race 28*b*. The outer race 28*a* is meshed with a helical spline 27*a* formed in the outer peripheral surface of the primary output shaft 27 so that the rotation of the primary output shaft 27 is transmitted to the outer race 28*a*. The overrunning clutch 28 is supported by a secondary output shaft 30 which is defined by an axially extended portion of the inner race 28*b*, the secondary output shaft 30 being fitted on the extended shaft portion of the armature rotary shaft 21*a* through a bearing 29. The outer periphery of the secondary output shaft 30 is supported through a bearing device 31 which is press-fitted to a front bracket 20*a* defining a machine frame of the starter 20 in such a manner that the secondary output shaft 30 is rotatable as well as axially slidable. The extended shaft portion of the armature rotary shaft 21*a* terminates at the position of the bearing device 31. The bearing device 31 consists of a bearing housing 31*a* having a U-shaped cross-section and a bearing 31*b* which is retained by the housing 31*a*. The side wall of the housing 31*a* is disposed on the side thereof which is closer to the overrunning clutch 28.

A stopper ring 32 is provided on the outer periphery of the secondary output shaft 30 at a position near the overrunning clutch 28. The ring 32 is adapted to abut against the side wall of the housing 31*a* of the bearing device 31 so as to limit the distance of travel of the overrunning clutch 28 when sliding axially together with the secondary output shaft 30 which is integral with the inner race 28*b*. Accordingly, if the ring 32 is forced to rotate by the secondary output shaft 30, friction occurring between the ring 32 and the housing 31*a* is increased. For this reason, the ring 32 is rotatably fitted on the secondary output shaft 30. The distal end portion of the secondary output shaft 30 passes through the front bracket 20*a* and projects outward therefrom. A pinion 33 which is engageable with a ring gear (not shown) of an engine is provided on the projecting end portion of the shaft 30.

It should be noted that, in FIG. 1, the reference numeral 34 denotes a washer provided on the extended shaft portion of the armature rotary shaft 21*a* to prevent the sun gear 24*a* from coming off, 35 a washer provided on the extended shaft portion to prevent axial sliding of the primary output shaft 27, 36 a retaining ring for preventing any axial movement of the washer 35, 37 a positioning stopper for the pinion 33, and 38 a stopper ring for positioning the stopper 37.

The operation of the starter in accordance with this embodiment will next be described.

When the electromagnetic switch 12 is energized, the shift lever 13 is pivoted and the overrunning clutch 28 is thereby shifted forwardly with the outer race 28*a* being kept engaged with the primary output shaft 27 through the helical spline 27*a*. As a result, the pinion 33 provided on the secondary output shaft 30 which is integral with the inner race 28*b* is meshed with the ring gear (not shown) of the engine. Immediately before or at substantially the same time as the pinion 33 is meshed with the ring gear, the main contacts of the electromagnetic switch 12 are closed, so that the power supply of the d.c. motor 21 is turned on and the armature rotary shaft 21*a* thus starts rotating. The rotation of the armature rotary shaft 21*a* causes the planet gears 24*c* to revolve through the sun gear 24*a* which is in spline engagement with the extended shaft portion of the shaft 21*a*. Thus, the rotation of the armature rotary shaft 21*a* is transmitted to the primary output shaft 27 which is integral with the carrier 24*d* after the speed of the rotation has been reduced by inner deceleration, and the rotation is further transmitted from the primary output shaft 27 to the outer race 28*a* of the overrunning clutch 28 through the helical spline 27*a*. Then, the rotation is transmitted to the inner race 28*b* through the rollers 28*c* and, as a result, the engine is started by the rotation of the pinion 33 provided on the secondary output shaft 30 which is integral with the inner race 28*b*. It should be noted that the reverse transmission of rotational force to the armature rotary shaft 21*a* after the starting of the engine is cut off by the overrunning clutch 28.

As has been described above, according to the present invention, the center bracket and the bearing fitted thereto which have heretofore been employed are eliminated, and instead the rotary shaft of the motor is extended forwardly so that the primary output shaft which is integral with the carrier of the epicyclic reduction gear is supported by the extended shaft portion, and the primary output shaft and the outer race of the overrunning clutch are spline-engaged with each other. Thus, it is possible to reduce the overall length of the starter by a large margin as compared with the prior art. Since it becomes unnecessary to employ the driving shaft and other elements which have heretofore been needed, the number of required parts is reduced and it becomes easy to center the carrier of the epicyclic reduction gear and the overrunning clutch. Accordingly, it is possible to improve the reliability of the starter.

Although the present invention has been described through specific terms, it should be noted here that the described embodiment is not necessarily exclusive and various changes and modifications may be imparted thereto without departing from the scope of the invention which is limited solely by the appended claim.

What is claimed is:

1. A starter comprising:

a motor having an armature rotary shaft which includes an extended shaft portion having a distal end, and a motor casing within which is supported at least said armature rotary shaft;

an epicyclic gear reduction train means coaxially disposed about and intermeshed with said armature rotary shaft;

an overrunning clutch means coaxially and slidably disposed about said armature rotary shaft;

a tubular primary output shaft means coaxially disposed about said armature rotary shaft for coupling between said epicyclic gear reduction train means and said overrunning clutch means;

a pinion gear means disposed coaxially with said armature rotary shaft;

a tubular secondary output shaft means having a proximal end and distal end for coupling between said overrunning clutch means and said pinion gear means, said tubular secondary output shaft means rotatably and coaxially attached at its proximal end about said armature rotary shaft and extending in the axial direction from and beyond the distal end of said armature rotary shaft;

a bearing means disposed intermediate the secondary output shaft and the motor casing to enable rotary support of as well as axial sliding of the secondary output shaft within a predetermined range; and shift means for applying axial force to cause said overrunning clutch to slide.

2. The starter as claimed in claim 1 wherein the bearing means in an axial direction is disposed between the overrunning clutch means and the pinion gear means.

3. The starter as claimed in claim 1 in which said bearing means is disposed coaxially with said armature rotary shaft and positioned substantially at the distal end of said armature rotary shaft.

4. The starter as claimed in claim 3 in which said pinion gear means is disposed at the distal end of said tubular secondary output shaft.

5. A starter comprising:

a motor having an armature rotary shaft which includes an extended shaft portion having a distal end, and a motor casing within which is supported at least said armature rotary shaft;

an epicyclic reduction train comprising a sun gear formed on the periphery of said extended shaft portion of the rotary shaft, a fixed-internal gear disposed around said sun gear, planet gears meshed with both said sun gear and said internal gear, and a carrier rotatably supporting said planet gears and revolving around said extended shaft portion;

a tubular primary output shaft formed integral with said carrier and extending in the axial direction of said extended shaft portion of the rotary shaft;

an overrunning clutch comprising an outer race being in spline engagement with said tubular primary output shaft so that said outer race can slide in the axial direction of said extended shaft portion of the rotary shaft, an inner race being rotatable and axially slidable, and rollers disposed between said outer race and said inner race so as to transmit the rotative force of said carrier to said inner race;

a tubular secondary output shaft formed integral with said inner race of the overrunning clutch, said tubular secondary output shaft rotatably and coaxially attached about said armature rotary shaft and extending in the axial direction from and beyond the distal end of said armature rotary shaft;

a bearing device disposed intermediate the secondary output shaft and the motor casing to enable rotary support of the secondary output shaft as well as axial sliding of the secondary output shaft within a predetermined range;

shift means for applying axial force to cause said overrunning clutch to slide; and a pinion formed at the distal end of said tubular secondary output shaft.

6. A starter according to claim 5, wherein said bearing device has a housing for retaining a bearing, a stopper ring is rotatably provided on the outer peripheral portion of said tubular secondary output shaft so that said stopper ring makes contact at the side portion of said housing to restrict the movement of said tubular secondary output shaft within a predetermined range.

7. A starter according to claim 5, wherein said sun gear of the epicyclic reduction train is fitted on said extended shaft portion of the rotary shaft through straight splines formed therebetween.

8. A starter according to claim 5, wherein said casing of the motor has an axially extending peripheral wall, and said inner gear of the epicyclic reduction train is formed on said axially extending peripheral wall of the casing.

9. A starter according to claim 5, wherein said carrier is rotatably supported by said tubular primary output shaft which fits on said extended shaft portion of the rotary shaft through a bearing.

10. A starter according to claim 5, wherein said outer race of the overrunning clutch engages with said carrier of the epicyclic reduction train through a helical spline.

11. A starter according to claim 5, wherein said tubular secondary output shaft is fitted on said extended shaft portion of the rotary shaft through a bearing.

12. A starter according to claim 5, wherein said shift means comprises an electromagnetic switch and a shift lever, and one end of said shift lever is engaged with a plunger rod and the outer end of said shift lever is engaged with said outer race of the overrunning clutch.

* * * * *